United States Patent [19]

Freed et al.

[11] Patent Number: 4,723,199

[45] Date of Patent: Feb. 2, 1988

[54] TUBULAR ELECTRIC LAMP FIXTURE

[75] Inventors: Herbert D. Freed, Miami Beach, Fla.; Eric Hoefnagels, Overloon, Netherlands

[73] Assignee: Emmanel Corporation, San Antonio, Tex.

[21] Appl. No.: 909,237

[22] Filed: Sep. 19, 1986

[51] Int. Cl.[4] ..... F21S 3/00; H01R 4/24

[52] U.S. Cl. ..... 362/219; 29/882; 29/884; 439/743

[58] Field of Search ..... 362/219; 29/882, 884; 339/220 R, 220 L, 221 L

[56] References Cited

U.S. PATENT DOCUMENTS

| | | | |
|---|---|---|---|
| 2,755,453 | 7/1956 | Cloutier | 339/220 R |
| 3,155,767 | 11/1964 | Schellack | 339/220 R |
| 4,158,221 | 6/1977 | Agabekov . | |
| 4,521,838 | 6/1985 | Agabekov . | |

OTHER PUBLICATIONS

F. Strasser, "Lanced Metal Eliminates Separate Fasteners" Product Engineering, pp. 63 and 65, 9/5/60.

*Primary Examiner*—Douglas Hart
*Attorney, Agent, or Firm*—Harold E. Meier

[57] ABSTRACT

A fixture for a plurality of tubular electric lamps comprises an elongated insulating angular frame having two perpendicular flanges joined together. Metal conductor strips carried on the back side of the flanges have integral lamp carrying tabs spaced along the length of the conductors that protrude through slots in the frame. Tabs are thus disposed along the entire length of the frame to support lamps in axial alignment. The flat conductors are secured to the back side of the flanges by crimping the portion of the tabs adjacent the front side of the flanges.

4 Claims, 3 Drawing Figures

TUBULAR ELECTRIC LAMP FIXTURE

TECHNICAL FIELD

This invention relates to lamp fixtures and specifically to a tubular electric lamp fixture for holding a plurality of elongated tubular electric lamps having contact caps at both ends.

BACKGROUND OF THE INVENTION

Fixtures for elongated, tubular lamps typically comprise an insulating support formed with two flat flanges disposed perpendicular to one another. Metal conducting strips are mounted to the surfaces of the two flanges with conducting tabs protruding from and disposed transverse to the respective strips. The conducting tabs extend through apertures in the flanges in alternate pairs with selected spacing and have aligned portions which include means for receiving the ends of tubular lamps along a common axis parallel to the angle support. The conductor strips are connected to a current supply and the tabs supply current to the lamps.

Heretofore, the manufacture of such light fixtures has involved a time consuming and expensive manufacturing procedure. The tabs are stamped in the conductor strips and then the conductor strips are riveted to the insulating support which requires the parts and special machinery for precise riveting. This riveting step greatly complicated the assembly process of known fixtures.

Connecting the conductor strips to the insulating material using adhesives has also been attempted, but this requires special parts for manufacturing the fixture and adhesives have been found not to be an effective means of fastening the conductor strips to the elongated supports for long periods of time, primarily because the metal strips are heated by operation of the lamps. Thus, connecting the conductor strip to the insulating fixture in an economical, time-efficient manner which does not use additional parts or materials and is not affected by heat is highly desirable. Heretofore, such advantages have not been possible with prior tubular electric lamp fixtures.

SUMMARY OF THE INVENTION

The present invention is a tubular electric lamp fixture comprising an elongated support frame and metal conductor strips with specially constructed tabs. The frame is an angular member formed from two flat elongated flanges disposed perpendicular to one another. A plurality of slots are formed along the length of the two flat flanges. Ribbing along the inside surface of the support frame provides additional strength to the frame structure. The metal conducting strips are mounted in longitudinal grooves formed in the back sides of the flanges.

Tabs are punched along the length of the conducting strips and extend perpendicularly through the slots in the flanges. The tabs have aligned portions which are formed with socket openings for receiving the end cap of a tubular electric lamp and an indent for guiding the end cap into the socket opening. After inserting the tabs through the slots the tabs are crimped near the flange surface to hold the conducting strips to the flanges.

When inserted through the slots in the associated flange, each tab is paired with a tab from the opposing conductor strip with a spacing corresponding to the length of the lamps. The lamp length is a function of the lamp wattage or lumens output. The axis of each lamp lies approximately along the intersection of both longitudinal planes projected perpendicularly from the center lines of the conducting strips and is parallel to the axis of the fixture. Thus, the flanges tend to intercept and reflect light from the fixture.

The light fixture of the present invention is installed at selected locations in a display cabinet or along a plane surface using screws, nails, adhesives or other fastening means. Reflectors, light diffusing covers or other ornamental devices may be mounted on or around the fixture. Self-adhesive strips may be affixed to the back side of the flanges to secure the fixture to a wall and to act as an insulator.

The present invention eliminates the disadvantage of prior fixtures by providing a lamp fixture of simple construction and low cost that can be constructed without a riveting or adhesive step for attaching the metal conducting strips to the flange.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
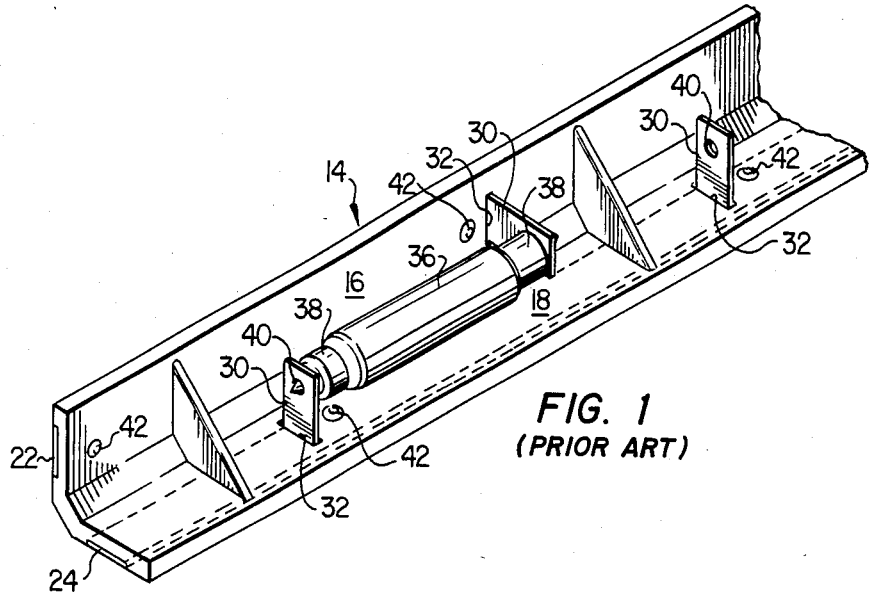
FIG. 1 (PRIOR ART)
FIG. 1 is a perspective view of a portion of a prior tubular light fixture with a section cutaway to show the conductor strips.

Referring now to FIG. 1, there is shown a prior art tubular electric lamp fixture 10 such as disclosed and described in U.S. Pat. Nos. 4,158,221 and 4,521,838. The lamp fixture 10 comprises an angled support member 14 formed from two perpendicular flanges 16 and 18. Metal conducting strips 22 and 24 extend along vertical grooves cut into the back faces of the flanges 14 and 18, respectively. Individual lamp-holding tabs 30 are formed out of the center of the conductor strips 22 and 24 and extend through slots 32 cut in the flanges 16 and 18. The end caps 38 of a tubular lamp 36 are inserted into socket openings 40 to mount the lamp 36 between two tabs 30, each of which extends from an opposing conductor strip 22 or 24. Rivets 42 hold the conducting strips to the flanges.

Figure 2:
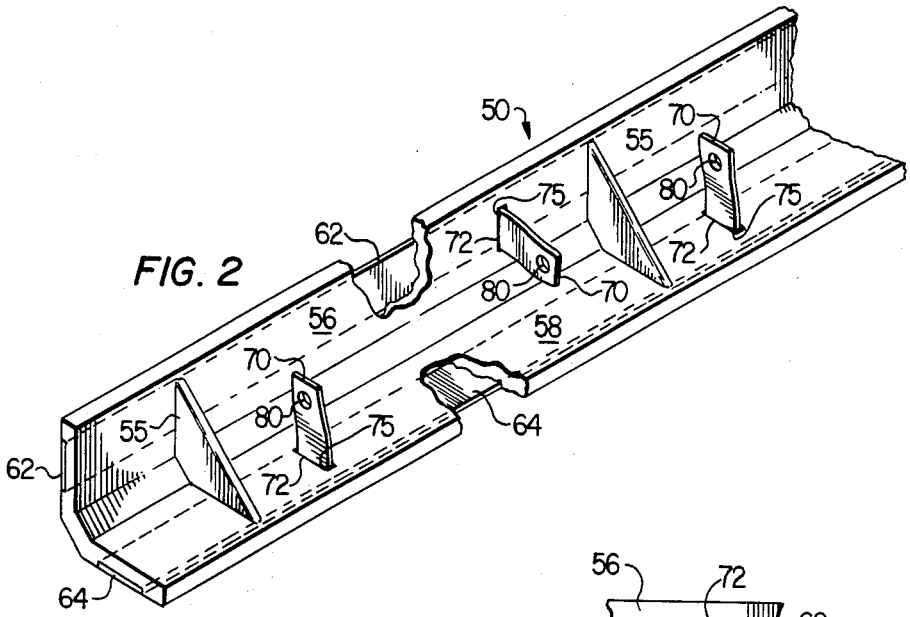
FIG. 2 is a perspective view, partially cutaway, of the tubular electric lamp fixture of the present invention.

Referring now to FIG. 2, there is shown a tubular electric lamp fixture 50 according to the present invention. The lamp fixture 50 comprises an elongated insulating angle support member 54 having two perpendicular flanges 56 and 58. Spaced along the inside of support member 54 are molded ribs or struts 55 integral to the perpendicular flanges 56 and 58. Metal conducting strips 62 and 64 are mounted in grooves cut along the back faces of the flanges 56 and 58, respectively. Tabs 70 formed out of the center of the conducting strips 62 and 64 extend through slots 72 in the flanges 56 and 58. Sockets 80 are punched into the ends of the tabs 70 to receive the end caps of a tubular lamp. The base 75 of each tab 70 is crimped (twisted slightly) as shown in FIG. 2 so that the crimped base 75 of each tab 70 holds the metal conducting strip 62 or 64 tightly to the back faces of the flanges 56 and 58 with the tabs 70 in proper position and alignment to hold a tubular lamp.

Figure 3:
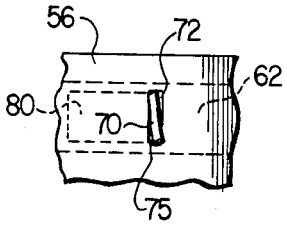
FIG. 3 is a top view of a portion of the support frame of the light fixture of FIG. 2 showing one tab extending through a slot on one of the flanges.

Referring to FIG. 3, there is depicted a top view of the flange 56 showing one of the tabs 70 extending through the slot 72. The tab 70 is crimped (twisted) at its base 75. The tab 70 is cut from the center 80 of the metal conducting strip as shown in dashed lines in FIG. 3.

Although a preferred embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A tubular electric lamp fixture for holding a plurality of tubular electric lamps comprising:

an elongated frame formed of insulating material and comprising a first and second longitudinally extending flange, each of said flanges having a front side and a back side, each of said back sides having a groove extending longitudinally along its entire length and each flange having a plurality of slots formed perpendicularly therethrough at predetermined positions;

a first electrically conductive flat metal strip having a plurality of integral lamp-carrying tabs cut at predetermined positions along the center of said strip and extending perpendicularly from said strip, said first strip extending longitudinally in and lying flat against the groove in the back side of the first flange such that the tabs cut in the first strip project through the slots along the length of said first flange; and a second electrically conductive flat metal strip having a plurality of integral lamp carrying tabs cut at predetermined positions along the center of said strip and extending perpendicularly from said strip, said second strip extending longitudinally in and lying flat against the groove in the back side of the second flange such that the tabs cut in the second strip project through the slots along the length of said second flange;

wherein each tab in the first strip cooperates with a specified tab in the second strip to form a tab pair so as to be capable of supporting at least one tubular lamp in a position substantially parallel to and spaced from the first side of the first and second flanges and wherein each tab projecting through the slots of said flanges is positioned so that the lower half of the projecting tab contacts the front side of its respective flange and thereby secures the metal conducting strip on the backside of the flange and so that the upper half of the projecting tab is in an aligned lamp holding position.

2. The fixture of claim 1 wherein said frame has integral structural ribs joined to the flanges of said frame and including a spacing wall lying between and connecting the flanges of the frame and having portions lying at an angle to each of said flanges of said frame.

3. The fixture of claim 1 wherein each of said tabs has a means for supporting the end cap of a lamp in substantial alignment with the longitudinal axis of the fixture and in substantial alignment with the means for supporting the end cap of the other tab of the pair and thereby being adapted to support a tubular lamp in a position substantially parallel to but spaced from both metal conducting strips.

4. A method for manufacturing a tubular electric lamp fixture for a plurality of tubular electric lamps comprising:

forming an elongated frame of insulating material, said frame comprising a first and second longitudinally extending flange, each of said flanges having a front side and a back side, each of said back sides having a groove formed therein extending longitudinally along its entire length and each flange having a plurality of slots formed therethrough at predetermined positions;

assembling a first strip having a plurality of integral lamp-carrying tabs at predetermined positions along the center of and extending perpendicularly from a first electrically conductive flat metal strip in and lying flat against the groove in the back side of the first flange such that the tabs in the first strip project through the spaced slots in the first flange;

positioning each tab projecting through the slots of said first flange so that the lower half of the projecting tab contacts the front side of the first flange and thereby secures the metal conducting strip on the backside of the first flange and so that the upper half of the projecting tab is in an aligned lamp holding position;

assembling a second strip having a plurality of integral lamp carrying tabs at predetermined positions along the center of and extending perpendicularly from a second electrically conductive flat metal strip in and lying flat against the groove in the back side of the second flange such that the tabs in the second strip project through the spaced slots in the second flange; and positioning each tab projecting through the slots of said second flange so that the lower half of the projecting tab contacts the front side of the second flange and thereby secures the metal conducting strip on the backside of the second flange and so that the upper half of the projecting tab is in an aligned lamp holding position;

wherein each tab in the first strip cooperates with a specified tab in the second strip so as to support a tubular lamp in a position substantially parallel to and spaced from the front sides of said first and second flanges.

* * * * *